US011476625B1

(12) United States Patent
Stansbury et al.

(10) Patent No.: US 11,476,625 B1
(45) Date of Patent: Oct. 18, 2022

(54) REPAIR ELECTRICAL PLUG ADAPTER

(71) Applicants: David Stansbury, Baldwin, LA (US); Anthony Stansbury, Baldwin, LA (US); Charles Stansbury, Baldwin, LA (US)

(72) Inventors: David Stansbury, Baldwin, LA (US); Anthony Stansbury, Baldwin, LA (US); Charles Stansbury, Baldwin, LA (US)

( * ) Notice: Subject to any disclaimer, the term of this patent is extended or adjusted under 35 U.S.C. 154(b) by 34 days.

(21) Appl. No.: 17/013,924

(22) Filed: Sep. 8, 2020

(51) Int. Cl.
*H01R 43/00* (2006.01)
*H01R 31/06* (2006.01)
*H01R 27/00* (2006.01)

(52) U.S. Cl.
CPC ..... *H01R 31/06* (2013.01); *H01R 27/00* (2013.01); *H01R 43/002* (2013.01)

(58) Field of Classification Search
CPC ..... H01R 31/06; H01R 27/00; H01R 43/002; H01R 25/003
See application file for complete search history.

(56) References Cited

U.S. PATENT DOCUMENTS 4,726,780 A 2/1988 Thackeray
5,135,409 A 8/1992 Thompson
5,616,968 A * 4/1997 Fujii ..... H02J 9/062 307/66
5,913,692 A 6/1999 Targett
6,080,004 A 6/2000 Kovacik
7,140,902 B2 11/2006 Burton
D589,328 S 3/2009 Edge
7,887,343 B2 * 2/2011 Ryan ..... H01R 25/003 439/133
8,070,524 B2 12/2011 Gencarelli
9,525,252 B2 * 12/2016 Kim ..... H01R 35/04
10,050,393 B1 * 8/2018 Calabrese ..... H01R 13/635
2003/0129869 A1 * 7/2003 Milan ..... H01R 25/003 439/214
2012/0234594 A1 * 9/2012 Peterson ..... H01R 25/003 174/560
2014/0350701 A1 * 11/2014 Underwood ..... H01R 31/005 700/83

FOREIGN PATENT DOCUMENTS

CN 107230877 A * 10/2017
CN 207217877 U * 4/2018 ..... H01R 13/6205
(Continued)

*Primary Examiner* — Tho D Ta
(74) *Attorney, Agent, or Firm* — Kyle A. Fletcher, Esq

(57) ABSTRACT

The repair electrical plug adapter is a replacement kit. The repair electrical plug adapter is used to repair one or more damaged NEMA 5-15 electric sockets. The repair electrical plug adapter comprises a housing and a plurality of NEMA 5-15 electric sockets. The repair electrical plug adapter is configured for use with a cable and a national electric grid. The plurality of NEMA 5-15 electric sockets attach to the housing. The plurality of NEMA 5-15 electric sockets replace the one or more damaged NEMA 5-15 electric sockets that are attached to the cable. The cable electrically connects the housing and the plurality of NEMA 5-15 electric sockets to the national electric grid. The national electric grid is a commercially available source of electric energy that is defined elsewhere in this disclosure.

18 Claims, 4 Drawing Sheets

(56) References Cited

FOREIGN PATENT DOCUMENTS

| | | | | | |
|---|---|---|---|---|---|
| CN | 109586123 | A | * | 4/2019 | |
| EP | 2797174 | A1 | * | 10/2014 | ..... H01R 13/4534 |
| KR | 20110044570 | A | * | 4/2011 | |
| WO | 02071549 | | | 9/2002 | |
| WO | WO-2015142056 | A1 | * | 9/2015 | ..... H01R 25/003 |

* cited by examiner

REPAIR ELECTRICAL PLUG ADAPTER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electricity and electrically conductive connections, more specifically, an intermediate component for linking two conductive devices. (H10R31/06)

SUMMARY OF INVENTION

The repair electrical plug adapter is a replacement kit. The repair electrical plug adapter is used to repair one or more damaged NEMA 5-15 electric sockets. The repair electrical plug adapter comprises a housing and a plurality of NEMA 5-15 electric sockets. The repair electrical plug adapter is configured for use with a cable and a national electric grid. The plurality of NEMA 5-15 electric sockets attach to the housing. The plurality of NEMA 5-15 electric sockets replace the one or more damaged NEMA 5-15 electric sockets that are attached to the cable. The cable electrically connects the housing and the plurality of NEMA 5-15 electric sockets to the national electric grid. The national electric grid is a commercially available source of electric energy that is defined elsewhere in this disclosure.

These together with additional objects, features and advantages of the repair electrical plug adapter will be readily apparent to those of ordinary skill in the art upon reading the following detailed description of the presently preferred, but nonetheless illustrative, embodiments when taken in conjunction with the accompanying drawings.

In this respect, before explaining the current embodiments of the repair electrical plug adapter in detail, it is to be understood that the repair electrical plug adapter is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the repair electrical plug adapter.

It is therefore important that the claims be regarded as including such equivalent construction insofar as they do not depart from the spirit and scope of the repair electrical plug adapter. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
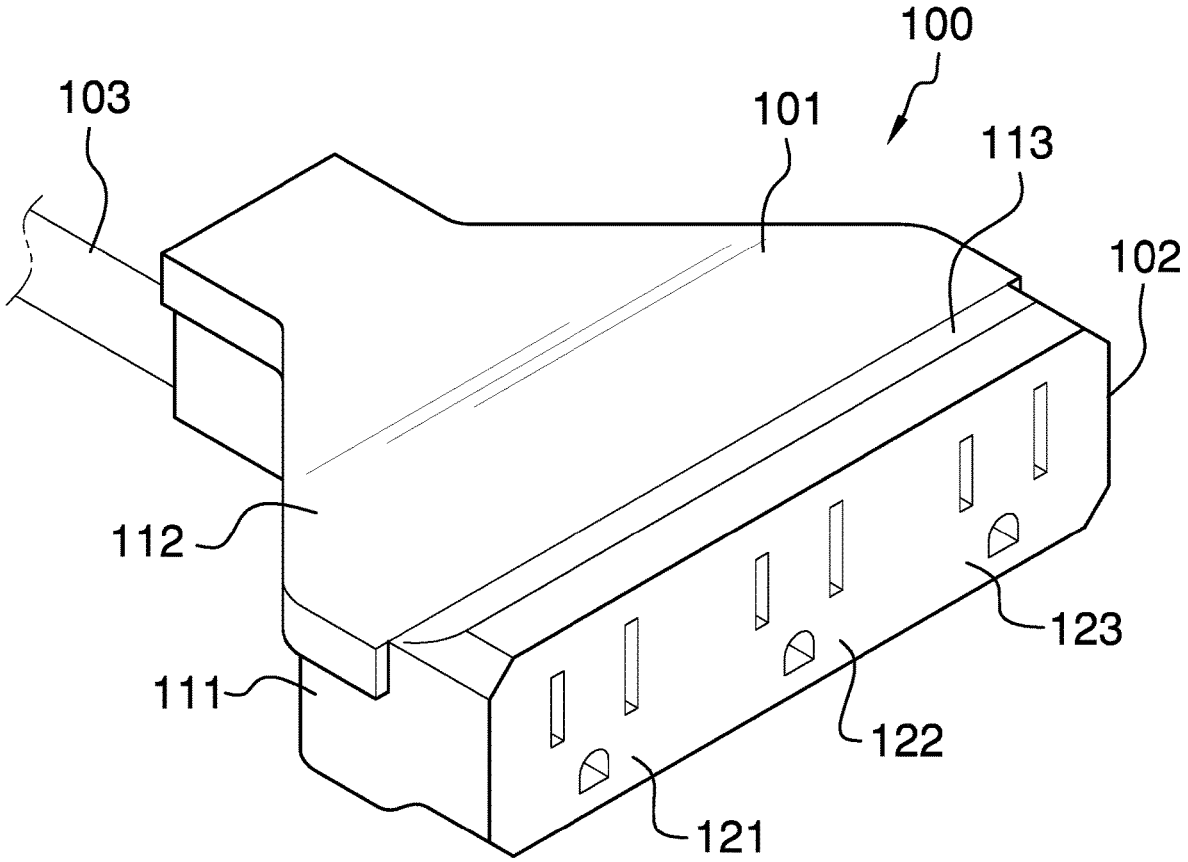
FIG. 1 is a perspective view of an embodiment of the disclosure.
Figure 2:
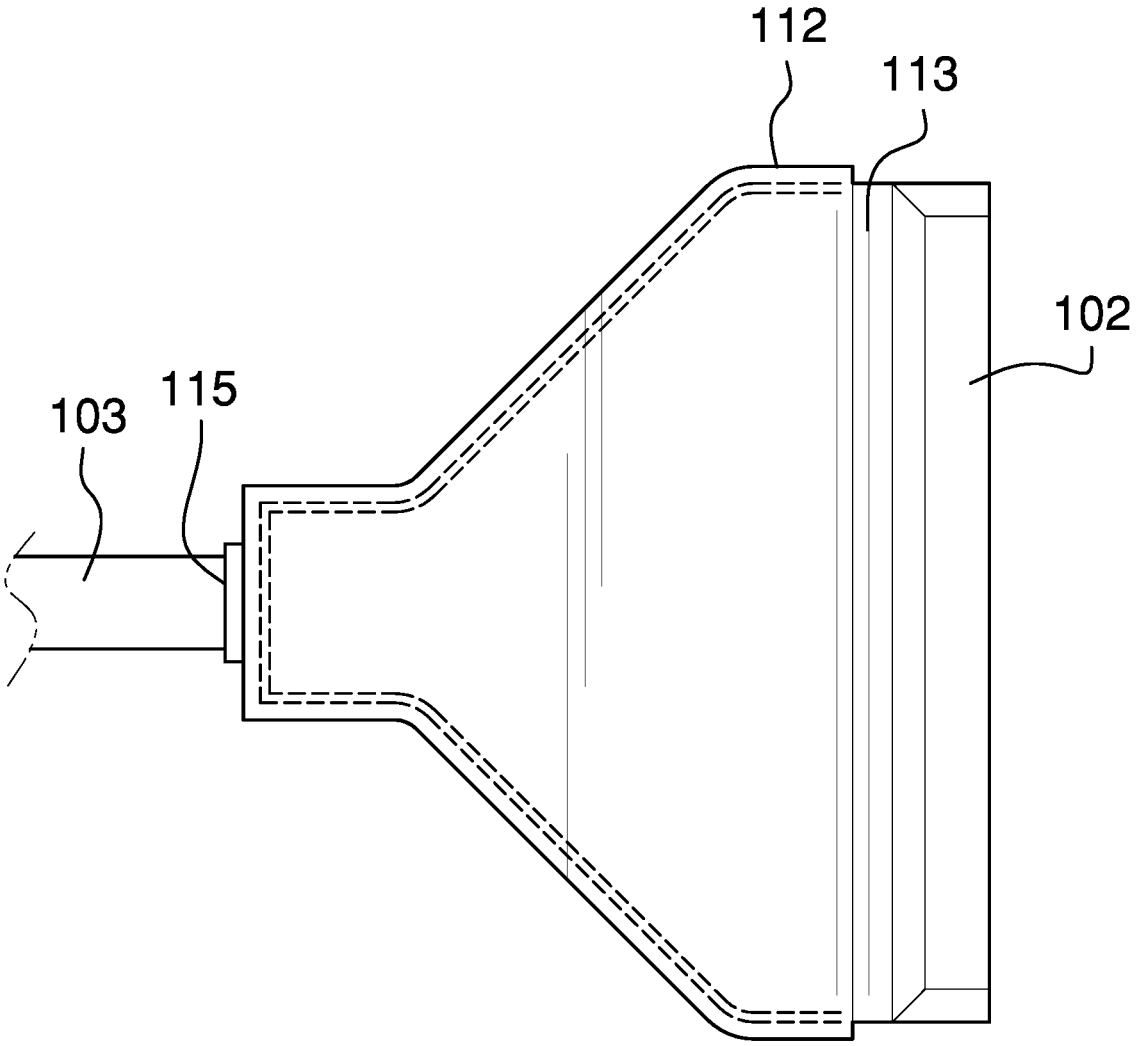
FIG. 2 is a top view of an embodiment of the disclosure.
Figure 3:
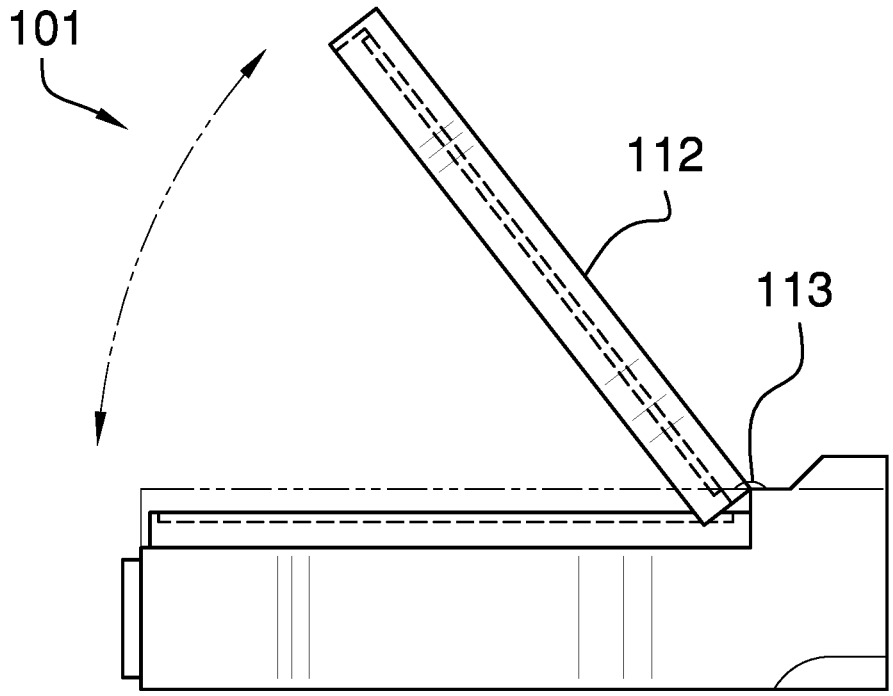
FIG. 3 is a side view of an embodiment of the disclosure.
Figure 4:
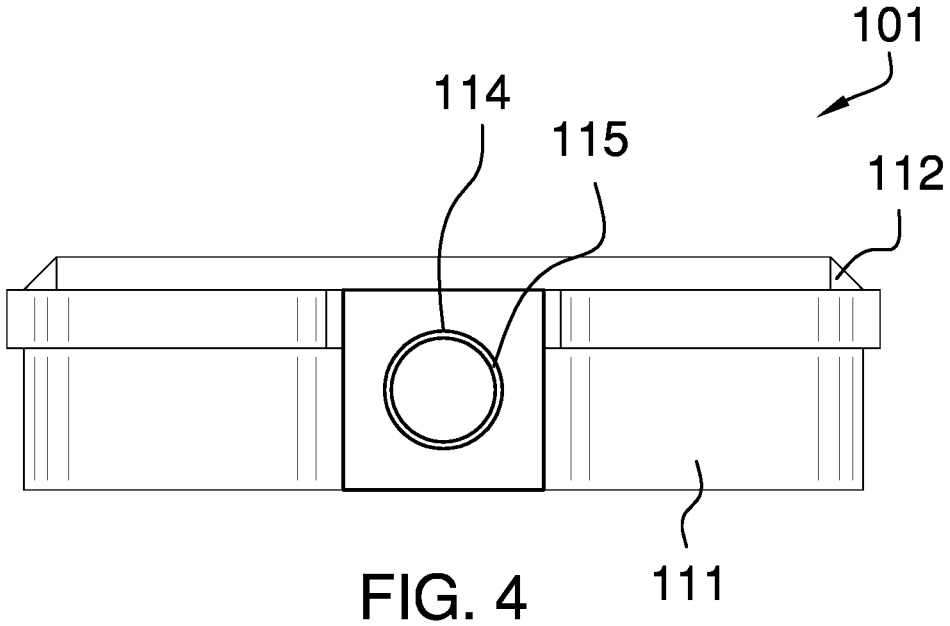
FIG. 4 is a rear view of an embodiment of the disclosure.
Figure 5:
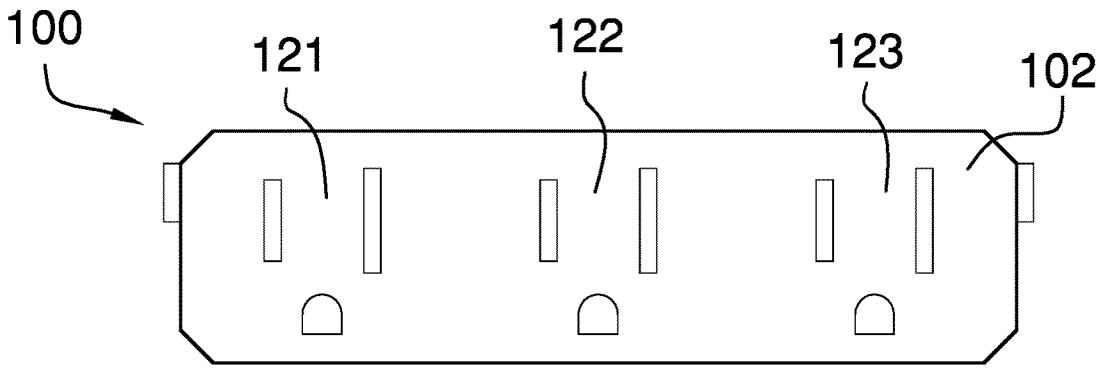
FIG. 5 is a front view of an embodiment of the disclosure.
Figure 6:
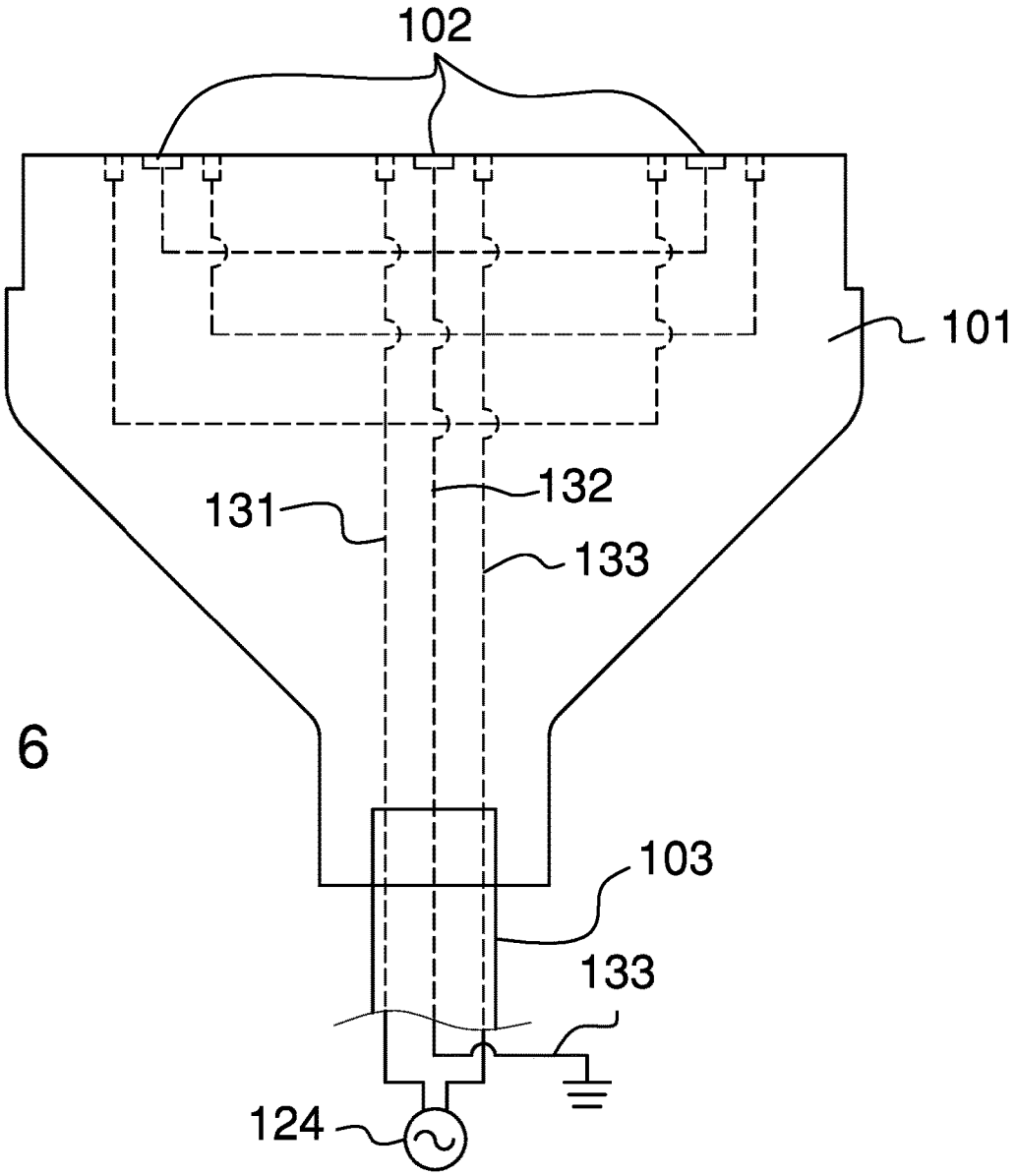
FIG. 6 is a schematic view of an embodiment of the disclosure.

Detailed reference will now be made to one or more potential embodiments of the disclosure, which are illustrated in FIGS. 1 through 6.

The repair electrical plug adapter 100 (hereinafter invention) is a replacement kit. The invention 100 is used to repair one or more damaged NEMA 5-15 electric sockets. The invention 100 comprises a housing 101 and a plurality of NEMA 5-electric sockets 102. The invention 100 is configured for use with a cable 103 and a national electric grid 104. The plurality of NEMA 5-15 electric sockets 102 attach to the housing 101. The plurality of NEMA 5-15 electric sockets 102 replace the one or more damaged NEMA 5-15 electric sockets that are attached to the cable 103. The cable 103 electrically connects the housing 101 and the plurality of NEMA 5-15 electric sockets 102 to the national electric grid 104. The national electric grid 104 is a commercially available source of electric energy that is defined elsewhere in this disclosure.

The cable 103 is an electrically conductive structure. The cable 103 electrically connects the national electric grid 104 to the plurality of NEMA 5-15 electric sockets 102. The cable 103 transmits electric energy from the national electric grid 104 to the plurality of NEMA 5-15 electric sockets 102. The cable 103 is defined elsewhere in this disclosure.

The national electric grid 104 is a commercially provided source of AC electric energy. The national electric grid 104 provides electric energy at a standardized frequency and voltage. The national electric grid 104 is defined elsewhere in this disclosure. The national electric grid 104 further comprises a hot lead 131, a neutral lead 132, and a ground lead 133.

The hot lead 131 is a lead that is provisioned by the national electric grid 104. The voltage presented to the plurality of NEMA 5-15 electric sockets 102 by the hot lead 131 varies as a sinusoidal function of time. The neutral lead 132 is a lead that is provisioned by the neutral lead 132. The voltage presented to the plurality of NEMA 5-15 electric sockets 102 by the neutral lead 132 is constant as a function of time. The ground lead 133 is an electrical connection that is required by the national electric grid 104 and the NEMA standards. The ground lead 133 provides each of the plurality of NEMA 5-15 electric sockets 102 with an electrical connection to the earth. The connection of the ground lead 133 to each of the plurality of NEMA 5-15 electric sockets 102 is a safety feature designed to dissipate electric energy away from an electric device in the event of the failure of the electric device.

The cable 103 electrically connects each of the plurality of NEMA 5-15 electric sockets 102 to the hot lead 131. The cable 103 electrically connects each of the plurality of NEMA 5-15 electric sockets 102 to the neutral lead 132. The cable 103 electrically connects each of the plurality of NEMA 5-15 electric sockets 102 to the ground lead 133.

The housing 101 is a rigid casing. The housing 101 is a hollow structure. The plurality of NEMA 5-15 electric sockets 102 mount on the housing 101. The cable 103 inserts into the hollow interior of the housing 101. The housing 101 forms a protected space that contains the electric connections between the plurality of NEMA 5-15 electric sockets 102 and the cable 103. The housing 101 is formed with all apertures and form factors necessary to allow the housing 101 to accommodate the use and operation of the plurality of NEMA 5-15 electric sockets 102 and the cable 103. Methods to form a housing 101 suitable for the purposes described in this disclosure are well-known and documented in the mechanical arts. The housing 101 comprises a pan 111, a lid 112, and a hinge 113.

The pan 111 is a prism-shaped structure. The pan 111 is a hollow structure. The pan 111 has a pan-shaped structure. The pan 111 forms a portion of the hollow interior that forms the protected space of the housing 101. The pan 111 further comprises a cable 103 aperture 114.

The cable 103 aperture 114 is an aperture formed through the lateral face of the prism structure of the pan 111. The cable 103 aperture 114 is a prism-shaped negative space that is geometrically similar to the cable 103. The span of the length of the inner dimension of the cable 103 aperture 114 is greater than the span of the length of the outer dimension of the cable 103 such that the cable 103 inserts into the protected space formed by the housing 101 through the cable 103 aperture 114. The cable 103 aperture 114 further comprises a cable 103 grommet 115.

The cable 103 grommet 115 is an elastic ring-shaped structure. The cable 103 grommet 115 inserts into the cable 103 aperture 114. The cable 103 grommet 115 inserts into the inner perimeter of the cable 103 aperture 114. The cable 103 inserts through the ring structure of the cable 103 grommet 115 as the cable 103 inserts into the pan 111 through the cable 103 aperture 114.

The cable 103 grommet 115 acts as a spring. Specifically, when the cable 103 inserts into the cable 103 grommet 115, the pressing of the cable 103 against the cable 103 grommet 115 applies a force that displaces the cable 103 grommet 115 in a direction that is perpendicular to the center axis of the cable 103 grommet 115. The elasticity of the cable 103 grommet 115 creates a force that opposes the displacement created by the insertion of the cable 103 into the cable 103 grommet 115. This opposing force is in a direction that returns the cable 103 grommet 115 to its relaxed shape. Because the cable 103 prevents the cable 103 grommet 115 from returning to its relaxed shape, the cable 103 grommet 115 applies a force against the cable 103 that holds the cable 103 grommet 115 in position and forms a fluid impermeable seal between the cable 103 and the cable 103 grommet 115.

The lid 112 is a prism-shaped structure. The lid 112 is a hollow structure. The lid 112 has a pan-shaped structure. The lid 112 is geometrically similar to the open face of the pan-shaped structure of the pan 111. The lid 112 attaches to the pan 111 such that the lid 112 rotates relative to the pan 111. The lid 112 rotates between a closed position and an open position. In the closed position, the lid 112 encloses the protected space protecting the electric connections between the cable 103 and the plurality of NEMA 5-15 electric sockets 102. In the open position, the lid 112 provides access to the electric connections contained in the pan 111.

The hinge 113 is a fastening structure that attaches the lid 112 to the pan 111. The hinge 113 attaches the lid 112 to the pan 111 such that the lid 112 rotates relative to the pan 111. The hinge 113 rotates the lid 112 between the open position and the closed position. In the first potential embodiment of the disclosure, the hinge 113 is a flexure bearing called a living hinge 113.

Each of the plurality of NEMA 5-15 electric sockets 102 is a NEMA 5-15 electric socket. The NEMA 5-15 electric socket is a standardized electric port used to transfer electric energy from the national electric grid 104 to a NEMA 5-15 electric plug. The NEMA 5-15 electric socket and the NEMA 5-15 electric plug are defined elsewhere in this disclosure. The NEMA 5-15 electric plug inserts into the NEMA 5-15 electric socket. The NEMA 5-15 electric plug transfers electric energy received from the national electric grid 104 through the NEMA 5-15 electric socket to an electrically powered device. In the first potential embodiment of the disclosure, the plurality of NEMA 5-15 electric sockets 102 comprises a first NEMA 5-15 electric socket 121, a second NEMA 5-15 electric socket 122, and a third NEMA 5-15 electric socket 123.

The first NEMA 5-15 electric socket 121 is a NEMA 5-15 electric socket that is intended to receive and transmit energy to a first NEMA 5-15 electric plug. The second NEMA 5-15 electric socket 122 is a NEMA 5-15 electric socket that is intended to receive and transmit energy to a second NEMA 5-15 electric plug. The third NEMA 5-15 electric socket 123 is a NEMA 5-15 electric socket that is intended to receive and transmit energy to a third NEMA 5-15 electric plug. The first NEMA 5-15 electric socket 121, the second NEMA 5-15 electric socket 122, and the third NEMA 5-15 electric socket 123 are electrically connected such that each NEMA 5-15 electric socket will simultaneously transmit electric energy to its associated NEMA 5-15 electric plug.

The following definitions were used in this disclosure:

Aperture: As used in this disclosure, an aperture is a prism-shaped negative space that is formed completely through a structure or the surface of a hollow structure.

Cable: As used in this disclosure, a cable is a collection of one or more insulated wires covered by a protective casing that is used for transmitting electricity or telecommunication signals.

Closed Position: As used in this disclosure, a closed position refers to a movable barrier structure that is in an orientation that prevents passage through a port or an aperture. The closed position is often referred to as an object being "closed."

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Electrical Ground: As used in this disclosure, an electrical ground is a common reference voltage that is used in the design and implementation of electrical circuits. An electrical ground is often, but not necessarily, the discharge point of electric currents flowing through an electric circuit.

Flexure Bearing: As used in this disclosure, a flexure bearing is a thin and flexible material that is used to attach, or bind, a first object to a second object such that the first object can rotate in a controlled direction relative to the second object.

Form Factor: As used in this disclosure, the term form factor refers to the size and shape of an object.

Function, Positive Function, and Negative Function: As used in this disclosure, a function refers to a defined relationship that generates a resulting value based on one or more given input values. A positive function refers to a defined relationship between a resulting value and one input value such that an increase of the input value always results in an increase in the resultant value. A negative function refers to a defined relationship between a resulting value and one input value such that an increase of the input value always results in a decrease in the resultant value. In circumstances where a function defines more than one input value, the positive function and the negative function will refer to a single input value under the assumption that the remaining input values remain constant.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grommet: As used in this disclosure, a grommet is an eyelet placed in a hole in a textile, sheet, or panel that protects a rope hook or cable passed through it and to protect the textile, sheet, or panel from being torn. See bushing and flange.

Hot Lead and Neutral Lead: As used in this disclosure, a hot lead is the source of the electric current that is provided by a voltage source. A neutral lead is the return for the electric current that is provisioned through the hot lead back to the voltage source.

Housing: As used in this disclosure, a housing is a rigid structure that encloses and protects one or more devices.

Inner Perimeter and Outer Perimeter: As used in this disclosure, the inner perimeter and the outer perimeter refer to two geometrically similar structures of an object. The inner perimeter refers to the geometrically similar structure with the shorter span. The outer perimeter refers to the geometrically similar structure with the greater span.

Lead: As used in this disclosure, a lead is a conductor that is physically used to electrically connect an electrical component into a larger circuit assembly.

Lid: As used in this disclosure, a lid is a removable cover that is placed over an opening of a hollow structure to enclose the hollow structure.

Living Hinge: As used in this disclosure, refers to a single object that is formed out of elastomeric material that is divided into a first segment, a second segment and the living hinge. The elastic nature of the elastomeric material allow the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid sells electrical power for use by an electrical load. The national electric grid invoices for electrical power based on the total energy consumed by the electrical load. The national electric grid measures the energy consumption of an electrical load with an electrical meter. See Hot Lead and Neutral Lead Negative Space: As used in this disclosure, negative space is a method of defining an object through the use of open or empty space as the definition of the object itself, or, through the use of open or empty space to describe the boundaries of an object.

NEMA: As used in this disclosure, NEMA is an acronym for National Electric Manufacturers Association. NEMA is a manufacturer's association known for publishing widely accepted technical standards regarding the performance of electrical power distribution equipment.

NEMA 5-15 Electrical Socket: As used in this disclosure, the NEMA 5-15 electrical socket is a port designed to provide electric power drawn from a source of electrical power consistent with the electrical power received through the National Electric Grid. The NEMA 5-15 electrical socket is commonly used to deliver electrical power to electric devices in residential, office, and light industrial settings. The typical NEMA5-15 electrical socket comprises a plurality of electric ports from which electric power is drawn. The position of each of the plurality of electric ports is placed in a standardized position. The typical NEMA5-15 electrical socket further comprises a plate hole which is a standardized hole located in a standardized position within the NEMA 5-15 electrical socket that is designed to receive a bolt that is used to attach a faceplate to the NEMA 5-15 electrical socket. The NEMA 5-15 electrical socket is also commonly referred to as an electrical outlet.

NEMA 5-15P Electrical Plug: As used in this disclosure, the NEMA 5-15P Electrical Plug is a plug that is designed to be inserted into a NEMA 5-15 Electrical Socket for the purpose of delivering electrical power to electrical devices. The NEMA 5-15P Electrical Plug is a 3 blade plug that is commonly found within residential and office environments within the United States.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Perimeter: As used in this disclosure, a perimeter is one or more curved or straight lines that bounds an enclosed area on a plane or surface. The perimeter of a circle is commonly referred to as a circumference.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a boundary structure, often referred to as a guard that prevents impacts from damaging the object contained within the protected space.

Relaxed Shape: As used in this disclosure, a structure is considered to be in its relaxed state when no shear, strain, or torsional forces are being applied to the structure.

Ring: As used in this disclosure, a ring is term that is used to describe a disk-like structure through which an aperture is formed. Rings are often considered loops.

Socket: As used in this disclosure, a socket is an electrical device that 1) forms an opening or a cavity that acts as a receptacle for an inserted object; and, 2) is designed to receive or transfer electricity to or from the object inserted in the socket.

Wire: As used in this disclosure, a wire is a structure with the general appearance of a cord or strand but that: 1) may not have the tensile or compressive characteristics of a cord; and, 2) is made from an electrically conductive material. See cord or strand With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A repair electrical plug adapter comprising a housing and a plurality of NEMA 5-15 electric sockets;

wherein the plurality of NEMA 5-15 electric sockets attach to the housing;

wherein the repair electrical plug adapter is configured for use with a cable and a national electric grid;

wherein the cable electrically connects the housing and the plurality of NEMA 5-15 electric sockets to the national electric grid;

wherein the repair electrical plug adapter is used to repair one or more damaged NEMA 5-15 electric sockets;

wherein the plurality of NEMA 5-15 electric sockets replace the one or more damaged NEMA 5-15 electric sockets that are attached to the cable;

wherein the plurality of NEMA 5-15 electric sockets mount on the housing;

wherein the cable inserts into the hollow interior of the housing;

wherein the housing comprises a pan, a lid, and a hinge;

wherein the hinge is a fastening structure that attaches the lid to the pan.

2. The repair electrical plug adapter according to claim 1 wherein the cable is an electrically conductive structure;
wherein the cable transmits electric energy from the national electric grid to the plurality of NEMA 5-15 electric sockets.

3. The repair electrical plug adapter according to claim 2 wherein the national electric grid is a commercially provided source of ac electric energy;
wherein the national electric grid provides electric energy at a standardized frequency and voltage.

4. The repair electrical plug adapter according to claim 3 wherein the national electric grid further comprises a hot lead, a neutral lead, and a ground lead;
wherein the hot lead is a lead that is provisioned by the national electric grid;
wherein the voltage presented to the plurality of NEMA 5-15 electric sockets by the hot lead varies as a sinusoidal function of time;
wherein the neutral lead is a lead that is provisioned by the neutral lead;
wherein the voltage presented to the plurality of NEMA 5-15 electric sockets by the neutral lead is constant as a function of time;
wherein the ground lead is an electrical connection that is required by the national electric grid and the NEMA standards;
wherein the ground lead provides each of the plurality of NEMA 5-15 electric sockets with an electrical connection to the earth.

5. The repair electrical plug adapter according to claim 4 wherein the cable electrically connects each of the plurality of NEMA 5-15 electric sockets to the hot lead;
wherein the cable electrically connects each of the plurality of NEMA 5-15 electric sockets to the neutral lead;
wherein the cable electrically connects each of the plurality of NEMA 5-15 electric sockets to the ground lead.

6. The repair electrical plug adapter according to claim 5 wherein the housing is a rigid casing;
wherein the housing is a hollow structure;
wherein the housing forms a protected space that contains the electric connections between the plurality of NEMA 5-15 electric sockets and the cable.

7. The repair electrical plug adapter according to claim 6 wherein the NEMA 5-15 electric socket is a standardized electric port used to transfer electric energy from the national electric grid to a NEMA 5-15 electric plug;
wherein the NEMA 5-15 electric plug inserts into the NEMA 5-15 electric socket;
wherein the NEMA 5-15 electric plug transfers electric energy received from the national electric grid through the NEMA 5-15 electric socket to an electrically powered device.

8. The repair electrical plug adapter according to claim 7, wherein in the first potential embodiment of the disclosure, the plurality of NEMA 5-15 electric sockets comprises a first NEMA 5-15 electric socket, a second NEMA 5-15 electric socket, and a third NEMA 5-15 electric socket;
wherein the first NEMA 5-15 electric socket is a NEMA 5-15 electric socket transmits energy to a first NEMA 5-15 electric plug;
wherein the second NEMA 5-15 electric socket is a NEMA 5-15 electric socket transmits energy to a second NEMA 5-15 electric plug;
wherein the third NEMA 5-15 electric socket is a NEMA 5-15 electric socket transmits energy to a third NEMA 5-15 electric plug.

9. The repair electrical plug adapter according to claim 8 wherein the first NEMA 5-15 electric socket, the second NEMA 5-15 electric socket, and the third NEMA 5-15 electric socket are electrically connected such that each NEMA 5-15 electric socket will simultaneously transmit electric energy to its associated NEMA 5-15 electric plug.

10. The repair electrical plug adapter according to claim 9
wherein the pan is a prism-shaped structure;
wherein the pan is a hollow structure;
wherein the pan has a pan-shaped structure;
wherein the pan forms a portion of the hollow interior that forms the protected space of the housing.

11. The repair electrical plug adapter according to claim 10
wherein the lid is a prism-shaped structure;
wherein the lid is a hollow structure;
wherein the lid has a pan-shaped structure;
wherein the lid is geometrically similar to the open face of the pan-shaped structure of the pan;
wherein the lid attaches to the pan such that the lid rotates relative to the pan.

12. The repair electrical plug adapter according to claim 11
wherein the lid rotates between a closed position and an open position;
wherein in the closed position, the lid encloses the protected space protecting the electric connections between the cable and the plurality of NEMA 5-15 electric sockets;
wherein in the open position, the lid provides access to the electric connections contained in the pan.

13. The repair electrical plug adapter according to claim 11
wherein the hinge attaches the lid to the pan such that the lid rotates relative to the pan;
wherein the hinge rotates the lid between the open position and the closed position;
wherein the hinge is a flexure bearing called a living hinge.

14. The repair electrical plug adapter according to claim 13
wherein the pan further comprises a cable aperture;
wherein the cable aperture is an aperture formed through the lateral face of the prism structure of the pan;
wherein the cable aperture is a prism-shaped negative space that is geometrically similar to the cable.

15. The repair electrical plug adapter according to claim 14 wherein the span of the length of the inner dimension of the cable aperture is greater than the span of the length of the outer dimension of the cable such that the cable inserts into the protected space formed by the housing through the cable aperture.

16. The repair electrical plug adapter according to claim 15
wherein the cable aperture further comprises a cable grommet;
wherein the cable grommet is an elastic ring-shaped structure;
wherein the cable grommet inserts into the inner perimeter of the cable aperture.

17. The repair electrical plug adapter according to claim 16 wherein the cable inserts through the ring structure of the cable grommet as the cable inserts into the pan through the cable aperture.

18. The repair electrical plug adapter according to claim 17 wherein the cable grommet is an elastomeric structure;

wherein the cable grommet forms a fluid impermeable seal between the cable and the cable grommet.

* * * * *